United States Patent [19]

Levinton

[11] 4,196,549

[45] Apr. 8, 1980

[54] TRIDIMENSIONAL MODULAR PARTS ASSEMBLY FOR CONSTRUCTING BUILDINGS

[76] Inventor: Ricardo H. Levinton, Luis M. Campos, 545-1426 Buenos Aires, Argentina

[21] Appl. No.: 899,415

[22] Filed: Apr. 24, 1978

[30] Foreign Application Priority Data

Apr. 26, 1977 [AR] Argentina ..... 267363

[51] Int. Cl.[2] ..... E04B 1/348; E04B 1/40

[52] U.S. Cl. ..... 52/15; 52/79.9

[58] Field of Search ..... 52/79.9, 79.1, 79.7, 52/79.8, 79.3, 79.2, 79.14, 15

[56] References Cited

U.S. PATENT DOCUMENTS

| | | | |
|---|---|---|---|
| 2,706,313 | 4/1955 | Radman | 52/79.8 |
| 3,529,386 | 9/1970 | Ostendorf | 52/79.3 |
| 3,690,077 | 9/1972 | Dalgliesh | 52/79.8 |
| 3,838,545 | 10/1974 | Kump | 52/79.8 |
| 4,012,871 | 3/1977 | Netto | 52/79.1 |

FOREIGN PATENT DOCUMENTS

| | | | |
|---|---|---|---|
| 658482 | 5/1965 | Belgium | 52/79.1 |

*Primary Examiner*—John E. Murtagh

*Attorney, Agent, or Firm*—Haseltine, Lake & Waters

[57] ABSTRACT

A tridimensional modular parts assembly for constructing buildings employing first, second and third modules, each formed by a prismatic body of rectangular base with rectangular perimetral walls extended perpendicularly to a corresponding base having formed holes therethrough. The second modules, coupable to the first modules formed by a rectangular base, with one of its longer sides having a length equal to that of the base of said first modules and a perimetral ring perpendicular to the base projecting from the edges of the base. There are substantially planar members perpendicular to the ring provided with holes therethrough so that they match the holes corresponding to those of the first modules. The third modules are coupable to the first modules, and are formed by a frustropiramidal casing, the larger base of which is substantially equally dimentioned as the base of the first modules. The casing is surrounded at its larger base by a skirt forming a perimetral gutter therewith. All edges of the first, second and third modules being chamfered whereby the coupling between each of the modules with the others is made by overlying the chamfered edges thereof.

4 Claims, 16 Drawing Figures

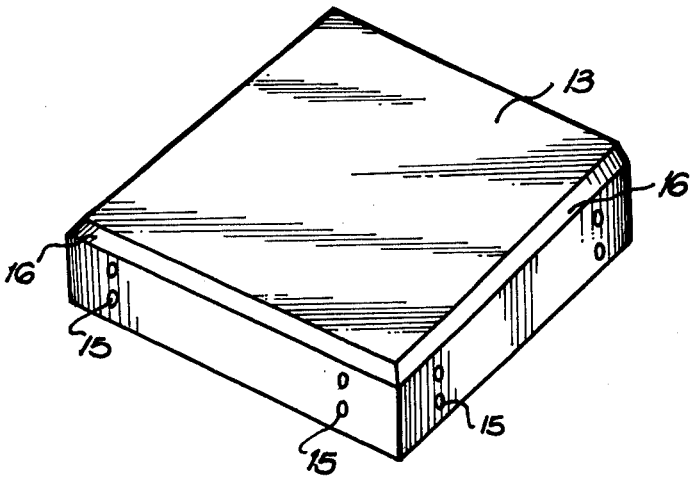
FIG. 5
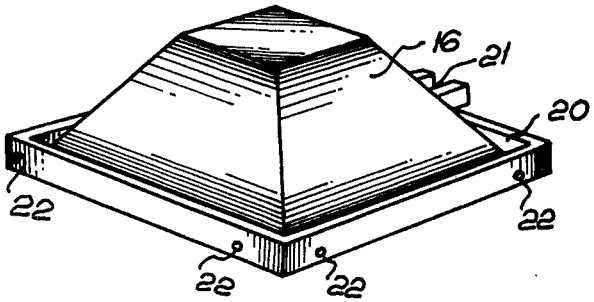
FIG. 6
FIG. 7
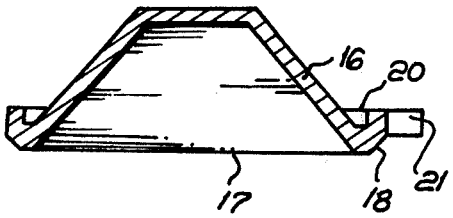

TRIDIMENSIONAL MODULAR PARTS ASSEMBLY FOR CONSTRUCTING BUILDINGS

The present invention is referred to an assembly of tridimensional modular parts for constructing buildings and its object is to provide the elements required and sufficient for the configuration of a spatial network comprised by octagons and squares permitting the construction of a building.

Within what is already known in the art there are two different large groups including the present modalities in the prefabricated construction, i.e.: the one employing bidimensional or plane elements and the other employing large tridimensional modules. The modalities corresponding to both groups afford different advantages and drawbacks, but neither of them affords a complete and efficient solution to the constructive problem.

The group employing bidimensional or plane elements has become somewhat popular in the market, offering a solution characteristic of the traditional mode, presenting the same drawbacks of the traditional system; excessive labor, excessive number of joints which are difficult to solve, the finishing should be made in-situ, including plastering, which does not rationalize construction appropriately.

On the other hand, the second group is characterized by comprising elements in the shape of complete rooms, which are premolded as one part alone. They have the drawback of the high weight, so that costly and huge equipment is required for lifting them, they do not solve the problems of finishing in-situ, i.e., the walls have to be plastered after molding. It is a closed system, meaning with this that the molds employed are useful only for one type of construction. Shipment is costly and difficult, from the viewpoint that whole empty rooms have to be transported. The orders for a profitable fabrication should exceed a quantity of 100 housing units or so.

Both modalities are not more economical than the traditional processes, but represent as their greatest advantage a speedy execution, neither of the mentioned modalities has yielded the results expected from them, and near the total of the construction of buildings follows on with the traditional processes involving a structure and masonry carried on "in situ".

Therefore, it is an object of the invention an assembly of tridimensional modules the configuration of which permits the combination therebetween according to a spatial network, forming a supporting structure with outer and inner enclosure and comprising also the facilities which complete the housing unit. It is possible, by means of said configuration, which include novel characteristics, to provide more economical and speedier execution and assembly "in situ", without the need to have recourse the shutterings and scaffoldings, with the additional solving of the mentioned defects originated by cracks and filtrations shown by known prefabricated constructions, and substantially eliminating the finishing work in the site.

Furthermore, the tridimensional modules constituting the object of the invention facilitate the building design work and the solution of details, improving the utilization of resistant sections as the tridimensional modules are both for support and enclosure; with the addition of direct tie columns there is no limit to the highness, practically. Contrary to the other two constructive groups which parts are not recoverable, these modules can be disassembled and reused, and reused again, so that with the addition of new modules new housing rooms are constructed in a few hours.

For the invention to be understood and practised in a simple manner, it has been shown in its preferred embodiments in the accompanied drawings, wherein:

FIG. 5 is a perspective view of another of the modules integrating the assembly of the invention, which we shall name floor module;

FIG. 6 is a perspective view of another of the modules integrating the assembly of the invention, which we shall name roof module;

FIG. 7 is a cross section view of the module shown in FIG. 6;

In all the figures, like reference numbers indicate like or corresponding parts of the tridimensional modular part assembly of the invention, which essentially comprises parts in the form of prismatic bodies of rectangular base 1, provided with flanges 2 extending perpendicularly to said base and having holes 3 formed therethrough.

Figure 3:
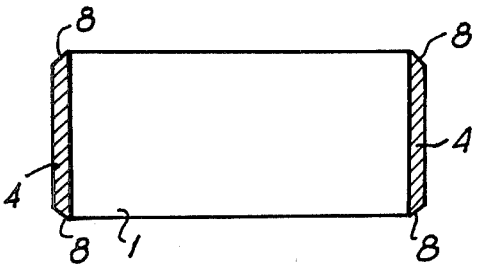
FIG. 3 is a similar view to that of FIG. 2, showing a varied embodiment of the wall module.
Figure 2:
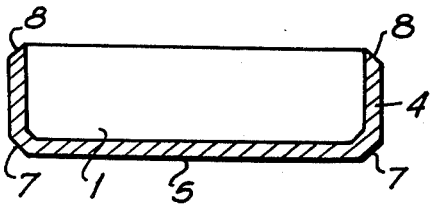
FIG. 2 is a cross section view of the module shown in FIG. 1.
Figure 4:
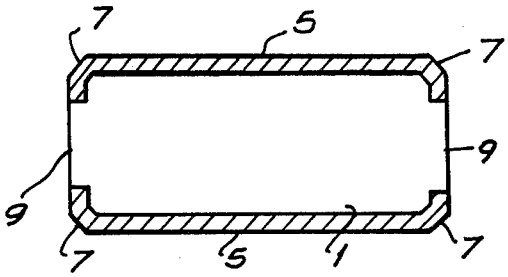
FIG. 4 is a view similar to FIG. 2, showing another variation of the wall module.
Figure 8:
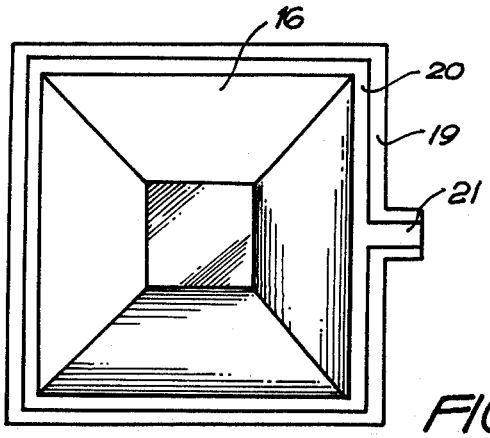
FIG. 8 is a plan view of the module shown in FIG. 6.

From the rectangular base 1, there are perpendicularly projected lateral planes 4 and 5, the number and position thereof being adapted to the corresponding type of module, as shown in FIGS. 2 through 4, in the case of the so called wall module.

Figure 1:
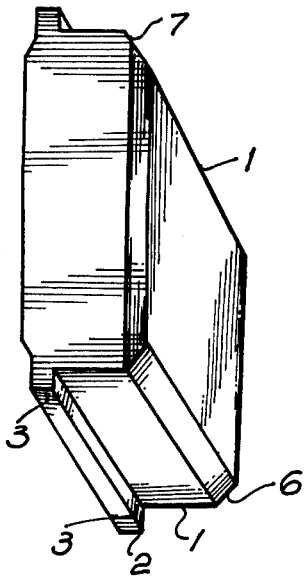
FIG. 1 is a perspective view of one of the modules integrating the invented assembly, which we shall name wall module.

The edges of attachment between base 1 and lateral planes 4 or 5 are chamfered as shown by 6 in FIG. 1 and the edges attaching lateral planes 4 and 5 one to the other are also chamfered, as shown by 7 in FIGS. 1 and 2 and the free edges of the lateral planes, as shown by 8 in FIGS. 2 and 3.

Figure 13:
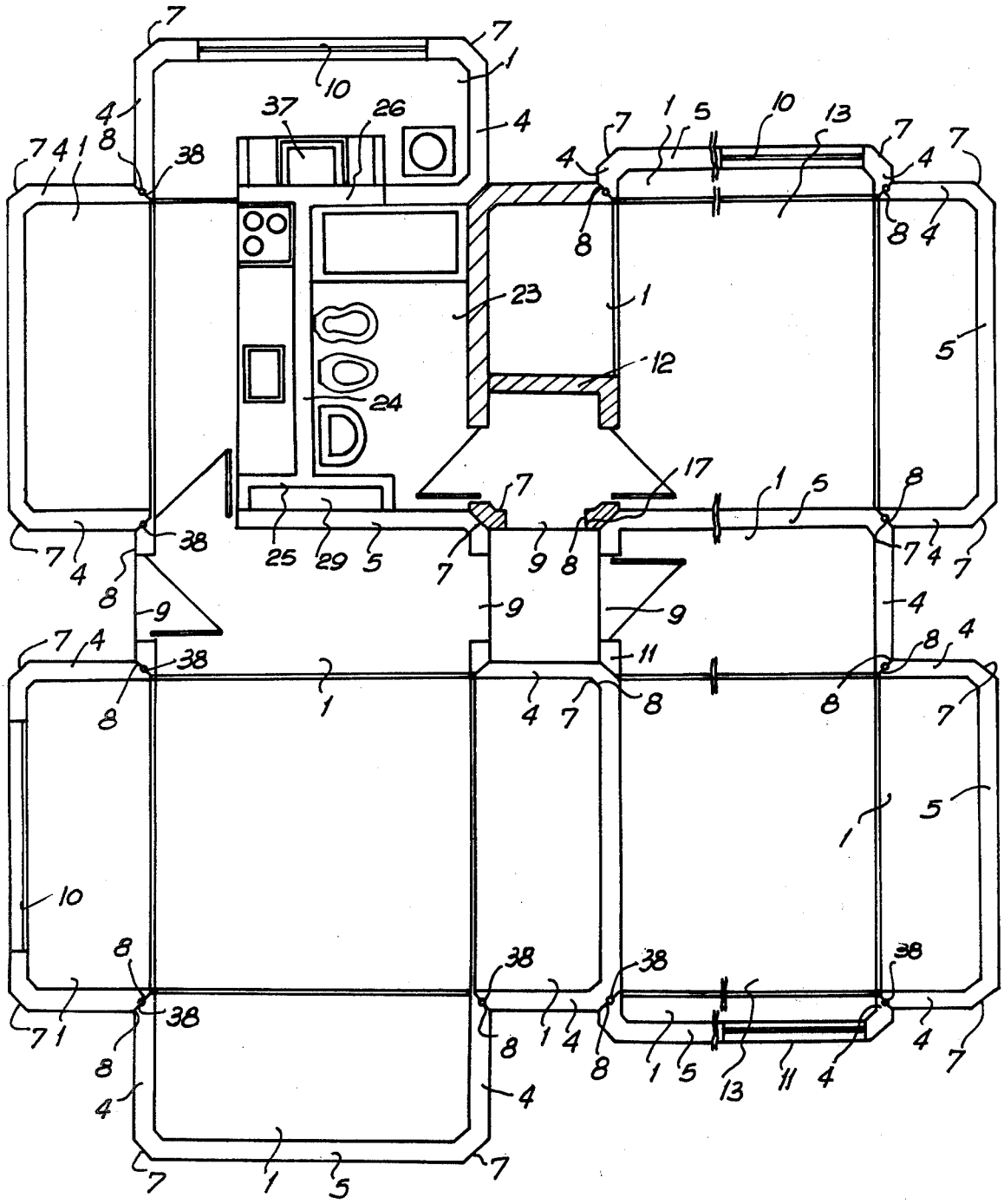
FIG. 13 is a plan view of a possible grouping of the modules constituting the assembly of the invention for composing a housing unit.
Figure 14:
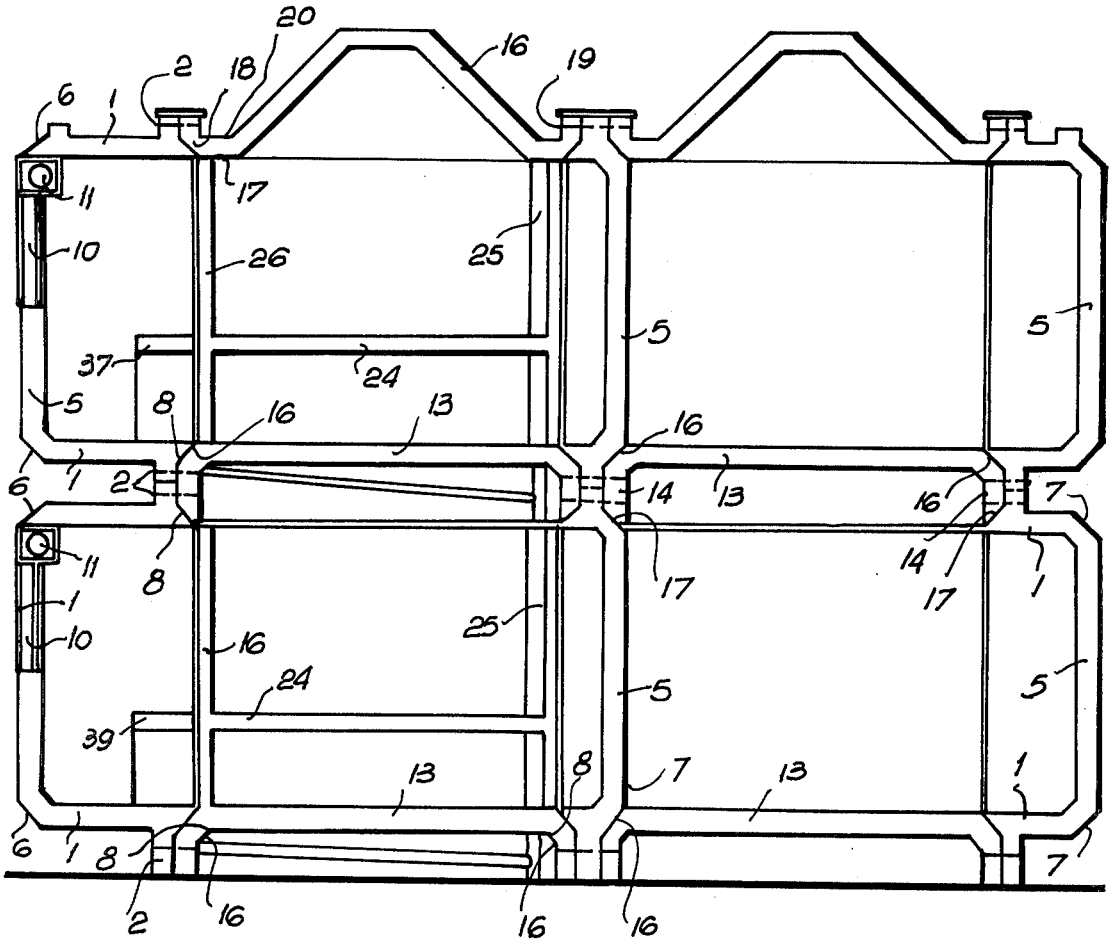
FIG. 14 is a cross section view with a vertical plane of another possible grouping of the modules constituting the assembly of the invention to compose a several story housing unit.

By varying the dimensions of base 1, as well as the position and number of the lateral planes 4 and 5, several variations of the wall module can be obtained, as shown by FIGS. 2 and 3; furthermore, openings 9 can be made in the lateral planes with the corresponding frames for door wings, or as illustrated in FIGS. 13 and 14 said lateral planes can carry the openings for windows 10 with their corresponding frames, rolling shutters and roller covers 11.

Figure 12:
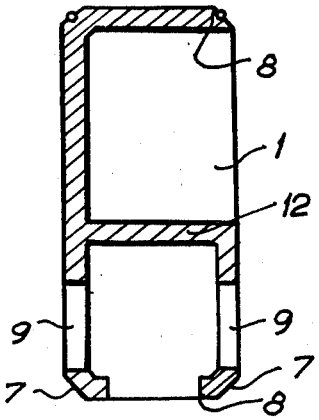
FIG. 12 is a cross section view of a variation corresponding to the wall module, which we shall name passage module.

Furthermore, as can be seen by FIG. 12, a wall module may incorporate an intermediate member 12, so that it can form what we shall call a passage module permitting its use as a means for communicating one room with the other, said intermediate member being of a substantially L-shaped section.

In FIG. 5 the so-called floor module is illustrated, which is configurated as a rectangular base 13, provided, as in the case of the wall module, the holes 15 passing therethrough.

Figure 16:
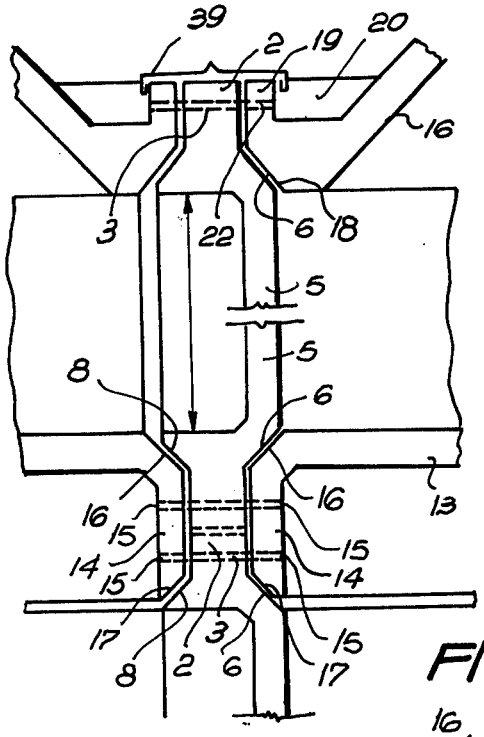
Figure 15:
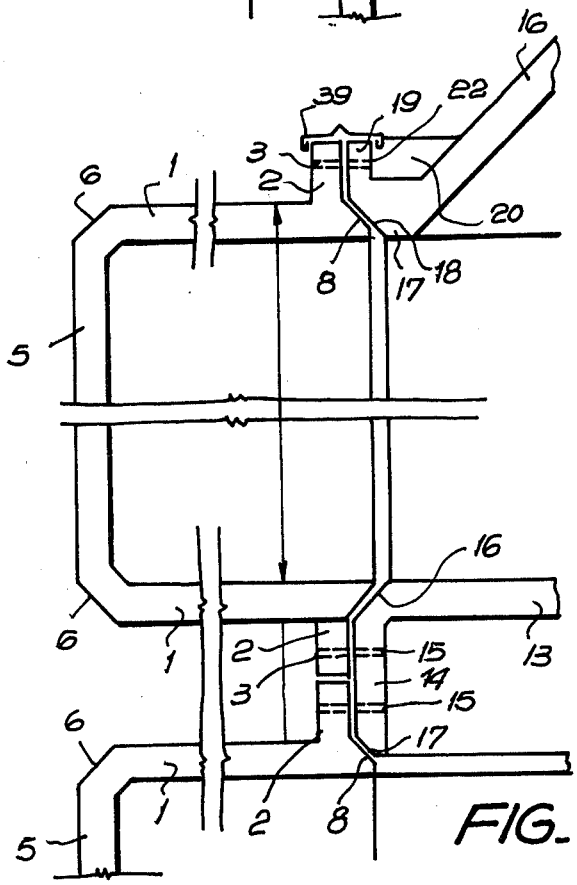
FIG. 15 is a cross section view showing a constructive detail of a possible joint between modules and, FIG. 16 is a view similar to FIG. 15, showing another possible manner of organizing the joints.

The joint edges of the rectangular base 13, with the flanges 2, as indicated in 16, are chamfered, as well as the free edges of said flanges, such as is illustrated by 17, in FIGS. 14, 15 and 16. It should be noted that the length of the rectangular base 13 sides is equal to that of the main sides of base 1 of the wall modules, so that the latter can be attached to former juxtaposing said sides, as shown in FIG. 13.

In FIG. 6 is illustrated the so-called roof module, consisting in a frustroconical casing 16 the base of which is limited by edges 17 conforming a rectangular perimeter like that of the rectangular base 13, of the floor module shown in FIG. 5. The edges 17 are also chamfered as illustrated in FIG. 7 with reference number 18, with a skirt 19 projecting from said edges 17, surrounding the casing and forming a peripherical rain gutter 20 which may open into a gargoyle 21 with right edges. The skirt 19 is provided with perforations 22 therethrough.

Figure 9:
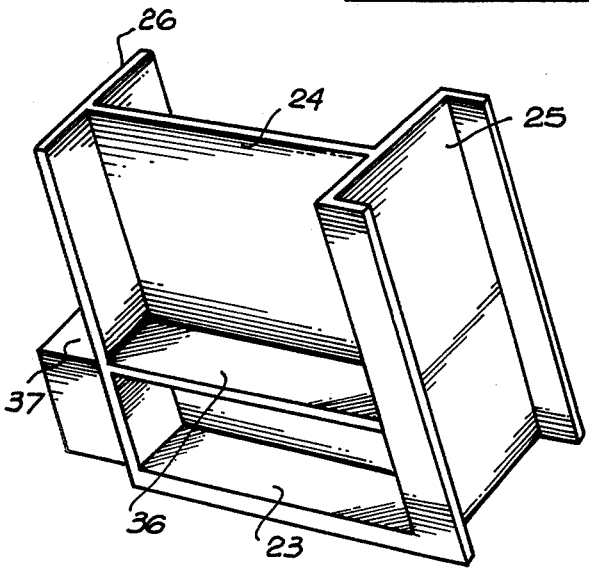
FIG. 9 is a perspective view of another of the modules integrating the assembly of the invention, which we shall name sanitary module.
Figure 10:
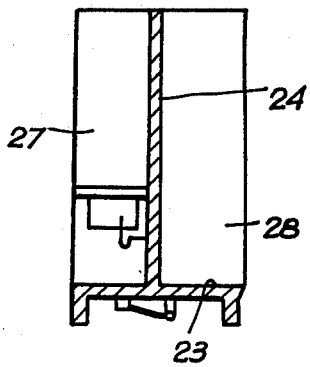
FIG. 10 is a view in cross section of the module shown in FIG. 9.
Figure 11:
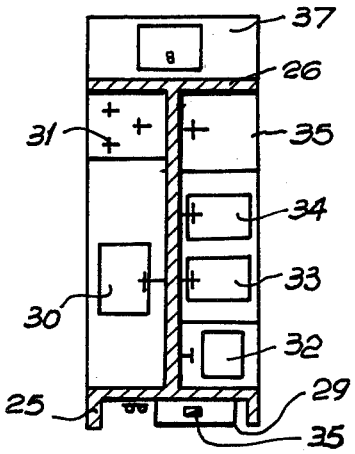
FIG. 11 is a plan view of the module shown in FIG. 9.

In FIG. 9 there is shown another variation of the wall module, constituting the so-called sanitary module, formed as a prismatic body with a rectangular base 23, with a plane element 24 raising from the center thereat, in the manner of a central division, while from the edges 23 perpendicular to the plane element 24 there are projected a substantially U-shaped element indicated with the reference number 25 and a plane member 26. Three enclosures 27, 28 and 29 are in this manner defined, permitting the positioning of the kitchen appliances 30 and 31, the sanitary appliances 32, 33, 34 and 35 and the uptakes and ventilation ducts 35. As in the previous cases the lengths of the sides of the rectangular base 23 are like those of the base 1 of the wall module. The sanitary module may be completed by including a table 36 and a sink 37, this module including also the required connections for all the elements indicated.

In FIG. 13 there is illustrated a housing arrangement obtained by means of the module assembly of the invention illustrating the manner of coupling by means of the vertical edges thereof, by virtue of the chambers thereof. It is also possible to observe that the free edges 8 of some wall modules, precisely those looking outside are provided with slots in the manner of channels which by joining them are formed in vertical ducts 38 actuating as decompression chambers for the wind filtrating through the outside joint, so that the rainwater drains downwardly and exits outside by its lower end.

In FIG. 14 a section by a vertical plane can be seen, showing how the coupling of the module assembly of the invention is organized to form a several story building; in this case the arrangement of columns in the intersection of the wall module edges, with said module attachment flanges 2 penetrating in an intermediate wall provided in the column which is of a section somewhat larger than the latter, attaching column and flange by bolting, soldering or any equivalent similar means.

The attachement between the different modules is realized by bolts passing through the holes 3 and 15, as may be seen in FIGS. 14, 15 and 16 wherein is shown, as well, the assembling of the roof modules with the wall modules.

Said assembly may also be effected by bolts passing through holes 3 and 22 which are formed in the skirt 19 and the flange 3, assuring the sealing of the joint by means of a panel strip of galvanized sheet or similar 39.

I claim:

1. A tridimensional modular parts assembly for constructing buildings having a roof disposed on to wall portions formed of modular members comprising: (a) first modules, each formed by a prismatic body of rectangular base provided with substantially rectangular perimetral walls extended perpendicularly to the corresponding base, said walls having holes formed therethrough; (b) second modules coupable to said first modules formed by a rectangular base, with one of its longer sides having a length equal to that of the base of said first modules, and being further defined by a perimetral ring perpendicular to said base projecting from the edges of said base, having substantially plane members, perpendicular to said ring projecting from opposite sides of said ring, provided with holes therethrough disposable to match the holes corresponding to those of the first modules and (c) third modules coupable to the first modules, said third modules being formed by a frustropiremidal casing, the larger base of which is substantially equally dimensioned as the base of the first modules, said casing being surrounded at its larger base by a skirt forming a perimetral gutter therewith, all the edges of the first, second and third modules being chamfered in such a manner that the coupling between each of the modules with the others is made by overlying the chamfered edges thereof.

2. A modular parts assembly as claimed in claim 1, wherein: at least one of the first modules is further provided with an intermediate member with an L-shaped section which is perpendicular to the base of said first module and having a branch of the L arranged perpendicularly to one of the perimetral walls.

3. A modular parts assembly as claimed in claim 1, wherein: there is further included at least a module formed of a rectangular base the larger sides which have a length equal to those corresponding to the bases of the first modules and a plane member parallel to said sides projecting from the center portion of said base, with a member having a U-shaped cross section projecting from one of the smaller sides of said base, a plane perpendicular to the latter projecting from the other of the smaller sides and the first mentioned plane member projecting the other of the smaller sides, the module being provided with at least a drain duct and water supply conduits for the disposition of a sanitary appliance in said module.

4. A modular parts assembly as claimed in claim 1, for use with a building constructed by juxtaposition of the first, second, third and fourth modules, along their chamfered edges.

* * * * *